US010661145B2

(12) United States Patent
Bartek et al.

(10) Patent No.: US 10,661,145 B2
(45) Date of Patent: May 26, 2020

(54) SPORTS SWING TRAINING DEVICE

(71) Applicant: BTE Enterprises LLC, Ledgewood, NJ (US)

(72) Inventors: Peter M. Bartek, Roxbury, NJ (US); Debby Murphy, Bedminster, NJ (US); Mirek Bogdanowicz, Hillsborough, NJ (US); Peter J D. Bartek, Roxbury, NJ (US)

(73) Assignee: BTE Enterprises, LLC, Ledgewood, NJ (US)

( * ) Notice: Subject to any disclaimer, the term of this patent is extended or adjusted under 35 U.S.C. 154(b) by 0 days.

(21) Appl. No.: 16/150,781

(22) Filed: Oct. 3, 2018

(65) Prior Publication Data

US 2019/0388761 A1 Dec. 26, 2019

Related U.S. Application Data

(60) Provisional application No. 62/763,543, filed on Jun. 28, 2018.

(51) Int. Cl.

| | |
|---|---|
| ***A63B 69/36*** | (2006.01) |
| ***A63B 57/00*** | (2015.01) |
| ***A63B 60/10*** | (2015.01) |
| *A63B 102/32* | (2015.01) |

(52) U.S. Cl.

CPC ..... *A63B 69/3635* (2013.01); *A63B 57/00* (2013.01); *A63B 60/10* (2015.10); *A63B 2102/32* (2015.10); *A63B 2220/40* (2013.01); *A63B 2220/51* (2013.01); *A63B 2220/56* (2013.01); *A63B 2230/105* (2013.01)

(58) Field of Classification Search

CPC .. A63B 69/3632; A63B 24/0021; A63B 60/46
See application file for complete search history.

(56) References Cited

U.S. PATENT DOCUMENTS

| | | | | |
|---|---|---|---|---|
| 5,439,217 | A * | 8/1995 | Ganger, Sr. ..... | A63B 69/3635 473/202 |
| 5,836,829 | A | 11/1998 | Van Cott et al. | |
| 6,179,723 | B1 | 1/2001 | Evans | |
| 9,067,116 | B1 | 6/2015 | Heikenen | |
| 9,492,728 | B2 | 11/2016 | Monroe | |
| 10,127,825 | B1 * | 11/2018 | Nguyen ..... | G10L 15/26 |
| 2006/0166738 | A1 * | 7/2006 | Eyestone ..... | A63B 15/005 463/36 |

(Continued)

*Primary Examiner* — James S. McClellan
*Assistant Examiner* — Kevin M Carter
(74) *Attorney, Agent, or Firm* — Kirk A. Wilson; Joseph T. Guy; Patent Filing Specialist, Inc.

(57) ABSTRACT

A sports swing training device is attachable to a sports striking-object, such as a golf club, tennis racket, or baseball bat, and uses multiple motion sensors, including accelerometers, gyroscopes and magnetometers, in conjunction with one or more microprocessors and device displays, to measure and display various swing metrics and to project flight patterns resulting from each swing. Swing data are displayed in graphic and/or indicia format, on the device's displays and are wirelessly transmitted to the displays of one or more external devices, such as smart phones or tablet computers. The projected flight patterns reveal flaws in the swing so as to promote corrective adjustments by the athlete.

20 Claims, 6 Drawing Sheets

(56) References Cited

U.S. PATENT DOCUMENTS

| | | | | |
|---|---|---|---|---|
| 2008/0059131 | A1* | 3/2008 | Tokita | G06F 3/011 703/5 |
| 2013/0085008 | A1 | 4/2013 | Hall | |
| 2013/0128022 | A1* | 5/2013 | Bose | H04N 7/18 348/77 |
| 2014/0347265 | A1* | 11/2014 | Aimone | G09G 3/003 345/156 |
| 2014/0366650 | A1* | 12/2014 | Thillainadarajah | A63B 69/36 73/862.625 |
| 2015/0215443 | A1* | 7/2015 | Heo | H04M 1/0202 455/556.1 |
| 2018/0169500 | A1 | 6/2018 | Kim | |
| 2019/0099650 | A1* | 4/2019 | Verrengia | A63B 69/3635 |

* cited by examiner

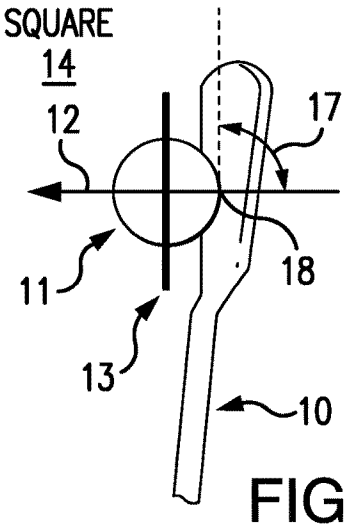
FIG. 1A
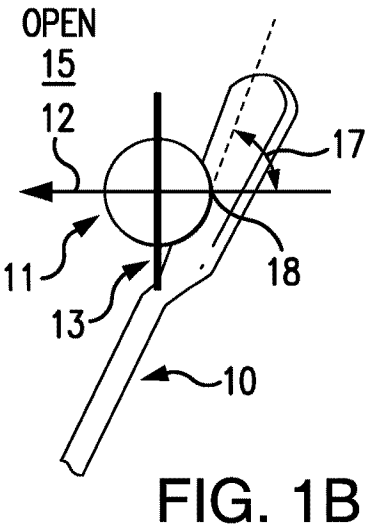
FIG. 1B
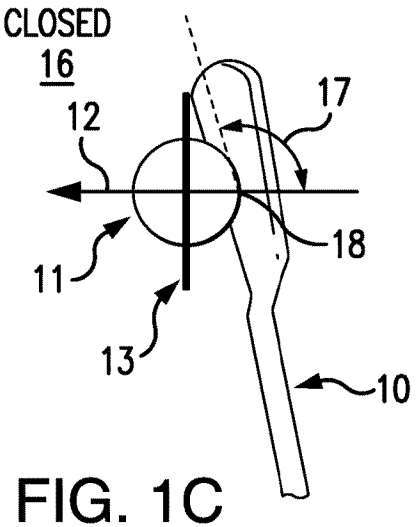
FIG. 1C
FIG. 2A
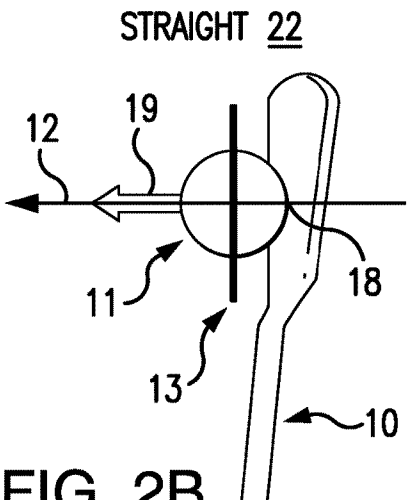
FIG. 2B
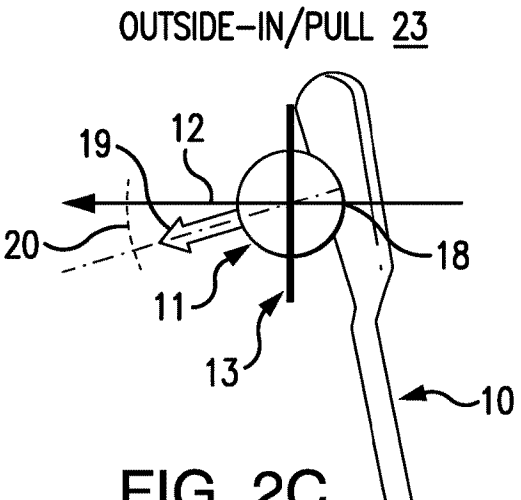
FIG. 2C

SPORTS SWING TRAINING DEVICE

REFERENCE TO RELATED APPLICATION

This application claims the benefit of the filing date of U.S. Provisional Patent Application No. 62/763,543, filed Jun. 28, 2018, which is incorporated herein by reference.

FIELD OF INVENTION

The present invention relates to the general field of sporting equipment, and more specifically to the field of sports training aids.

BACKGROUND OF THE INVENTION

A number of sports share the central feature of a club, bat, racket or stick (hereinafter collectively referred to as a "sports striking object") which an athlete swings to hit or strike a ball or puck (hereinafter referred to as a "propelled object"). Such sports include golf, baseball, tennis and hockey, among others. There are several metrics that make up an effective swing of the sports striking object in any of these sports. The most critical swing metrics include: (i) the positioning and pressure of the athlete's hands and fingers on the handle of the sports striking object; (ii) the timing and tempo of the swing; (iii) the velocity and acceleration of the sports striking object during the swing and the follow-through; (iv) the angular velocity and angular orientation of the sports striking object during the swing and follow-through; (v) the directional orientation of the sports striking object with respect to a striking plane corresponding to a square impact on the center of the ball/puck in the target direction (hereinafter referred to as the "targeted striking plane"); and (vi) the directional orientation of the swing path of the sports striking object with respect to the targeted striking plane.

There is a need, as yet unmet by the prior art, for a device which will monitor and analyze the foregoing swing metrics in a way that will identify specific flaws in an athlete's swing and thereby suggest corrective measures.

SUMMARY OF THE INVENTION

A key swing metric is the contact orientation of the face of the club, racket, bat, stick, etc. (the "sports striking object") at the point of contact with the ball, puck, etc. (the "propelled object"). Referring to FIGS. 1A-1C, the exemplary sports striking object is a golf club 10 and the exemplary propelled object is a golf ball 11. In these illustrations, the golf hole is the target, and a straight line between the center of the ball 11 and the target defines the target direction 12. A plane passing through the center of the ball 11 perpendicular to the target direction defines the targeted striking plane 13.

When a golf swing is properly executed, the contact orientation of the club head 10 is square-faced 14, as depicted in FIG. 1A. In the square-faced orientation 14, the club head 10 at the contact point 18 is parallel to the targeted striking plane 13 and perpendicular to the target direction 12. (The angle between the contact orientation of the sports striking object 10 and the target direction is hereinafter referred to as the "target offset angle" 17.) This square-faced orientation 14 is optimal because the entire horizontal component of the force of the swing is in the direction of the target, thereby maximizing the distance of the ball's flight toward the target.

FIG. 2B depicts an open-faced contact orientation 15 of the club head 10, in which the club head 10 at the contact point 18 is rightward oblique to the targeted striking plane 13 and is at an acute target offset angle 17 to the target direction 12. This open-faced orientation 15 directs a portion of the horizontal swing force (equal to the horizontal force multiplied by the cosine of the target offset angle 17) to the right of the target, thereby reducing the ball's flight distance toward the target.

FIG. 1C depicts a closed-faced contact orientation 16 of the club head 10, in which the club head 10 at contact with the ball 11 is leftward oblique to the targeted striking plane 13 and is at an obtuse offset angle 17 to the target direction 12. This closed-faced orientation 16 directs a portion of the horizontal swing force (equal to the horizontal force multiplied by the cosine of the target offset angle 17) to the left of the target, thereby reducing the ball's flight distance toward the target.

Another important swing metric is the orientation of the swing path 19 through the contact point 18, as illustrated in FIGS. 2A-2C, again in the context of a golf swing. Here there is a path offset angle 20 defined between the swing path 19 and the target direction 12.

As shown in FIG. 2A, an "inside-out" or push path 21 is rightward oblique to the targeted striking plane 13 and at a rightward acute path offset angle 20 to the target direction 12. This push path 21 of the swing directs a portion of the horizontal swing force (equal to the horizontal force multiplied by the sine of the path offset angle 20) to the right of the target, thereby reducing the ball's flight distance toward the target.

As shown in FIG. 2B, the optimal swing path is the straight path 22, in which the swing path 19 is perpendicular to the targeted striking plane 13 and is aligned with the target direction 12, with a path offset angle 20 of zero. Since this straight path 22 of the swing directs the entire horizontal swing force in the direction of the target, it maximizes the ball's flight distance toward the target.

As shown in FIG. 2C, an "outside-in" or pull path 23 is leftward oblique to the targeted striking plane 13 and at a leftward acute path offset angle 20 to the target direction 12. This pull path 23 of the swing directs a portion of the horizontal swing force (equal to the horizontal force multiplied by the sine of the path offset angle 20) to the left of the target, thereby reducing the ball's flight distance toward the target.

The present invention is a device that uses an array of motion sensors on the sports striking object and/or on the athlete in conjunction with at least one microprocessor to compute the metrics of each swing taken by the athlete, including the linear and angular velocities and accelerations and the directional orientations of the sports striking object 10 over time and at the contact point 18 with the propelled object 11. These swing data are displayed, in graphic and/or indicia format, on the device's LED or LCD displays and/or are wirelessly transmitted to the displays of one or more external devices, such as smart phones.

Among the device's computed swing metrics are the contact face orientation of the sport striking object 10—square, open or closed, as illustrated in FIGS. 1A-1C—and the associated target offset angle 17, as well as the contact swing path orientation—straight, push or pull, as illustrated in FIGS. 2A-2C—and the associated path offset angle 20. As shown in FIG. 3 and FIG. 4, in the exemplary context of a golf swing, the contact face orientation metrics and the contact swing path orientation metrics are combined by the device's microprocessor to classify each swing in one of nine flight patterns:

Pull-Hook 1, corresponding to a closed-faced orientation 16 and a pull swing path 23;

Pull 2, corresponding to a square-faced orientation 14 and a pull swing path 23;

Pull-Slice 3, corresponding to an open-faced orientation 15 and a pull swing path 23;

Draw 4, corresponding to a closed-faced orientation 16 and a straight swing path 22;

Straight 5, corresponding to a square-faced orientation 14 and a straight swing path 22;

Fade 6, corresponding to an open-faced orientation 15 and a straight swing path 22;

Push-Hook 7, corresponding to a closed-faced orientation 16 and a push swing path 21;

Push 8, corresponding to a square-faced orientation 14 and a push swing path 21, and Push-Slice 9, corresponding to an open-faced orientation 15 and a push swing path 21.

The computed flight patterns 1-9 are rendered graphically and/or as indicia for each swing on the device's displays, thereby enabling the athlete to immediately see the flaws in his/her wing and the swing mechanics in need of correction. Unlike other swing training devices which deluge the athlete with opaque data, the present invention distills the swing data to a form that inherently and directly reveals the necessary swing adjustments to be made to achieve optimal results. For example, a flight pattern of Pull-Hook 1 directly informs the golfer that he/she must correct both a closed club face orientation and an "outside-in" swing path, while a flight pattern of Fade 6 informs the golfer that his/her straight swing path is correct, but he/she must square up his/her club face at contact.

This sports swing training device also features a pair of grip pressure sensors, one for each of the athlete's hands, which can be installed in a dedicated grip handle on the device itself on an applied flexible overlay on a swing handle of the sports striking object, such as the handle of a golf club, tennis racket, baseball bat, or hockey stick. The grip pressure sensors can contain piezo-resistive force sensors, piezo-electric force sensors, force-sensitive resistors, and/or capacitive force sensors. Sensor generated grip pressure data is analyzed by the microprocessor and rendered as indicia—for example, grip force levels 0-9, on paired LED displays. Here again, the athlete is given feedback that is immediately usable to correct swing flaws, since excessive grip pressure is a common error that impedes the release of the wrists during the swing, which is essential to adequate acceleration of the sports striking object during contact and follow-through.

Since timing and tempo are also essential to proper swing mechanics, the device includes a speaker which receives periodic audible output from an electronic metronome. The period interval between "ticks" of the metronome is adjustable to synchronize with an individual athlete's swinging motion. The device speaker is also used to give an audible signal confirming a specified velocity and/or acceleration of the sports striking object during contact and follow-through.

Optionally, the device can include a remote EEG sensor that wirelessly communicates with the device microprocessor. The microprocessor analyzes the EEG sensor data to determine the athlete's attention level during each swing. The attention level is displayed on a series of multi-colored LED lights—for example, from red to yellow to green, with the latter indicating adequate attentiveness.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

BRIEF DESCRIPTION OF THE DRAWINGS

FIGS. 1A-1C are schematic diagrams illustrating three contact orientations between an exemplary sports striking object (golf club) and an exemplary propelled object (golf ball);

FIGS. 2A-2C are schematic diagrams illustrating three swing path orientations of an exemplary sports swing (golf) through a targeted striking plane;

DETAILED DESCRIPTION OF THE PREFERRED EMBODIMENT

Figure 5:
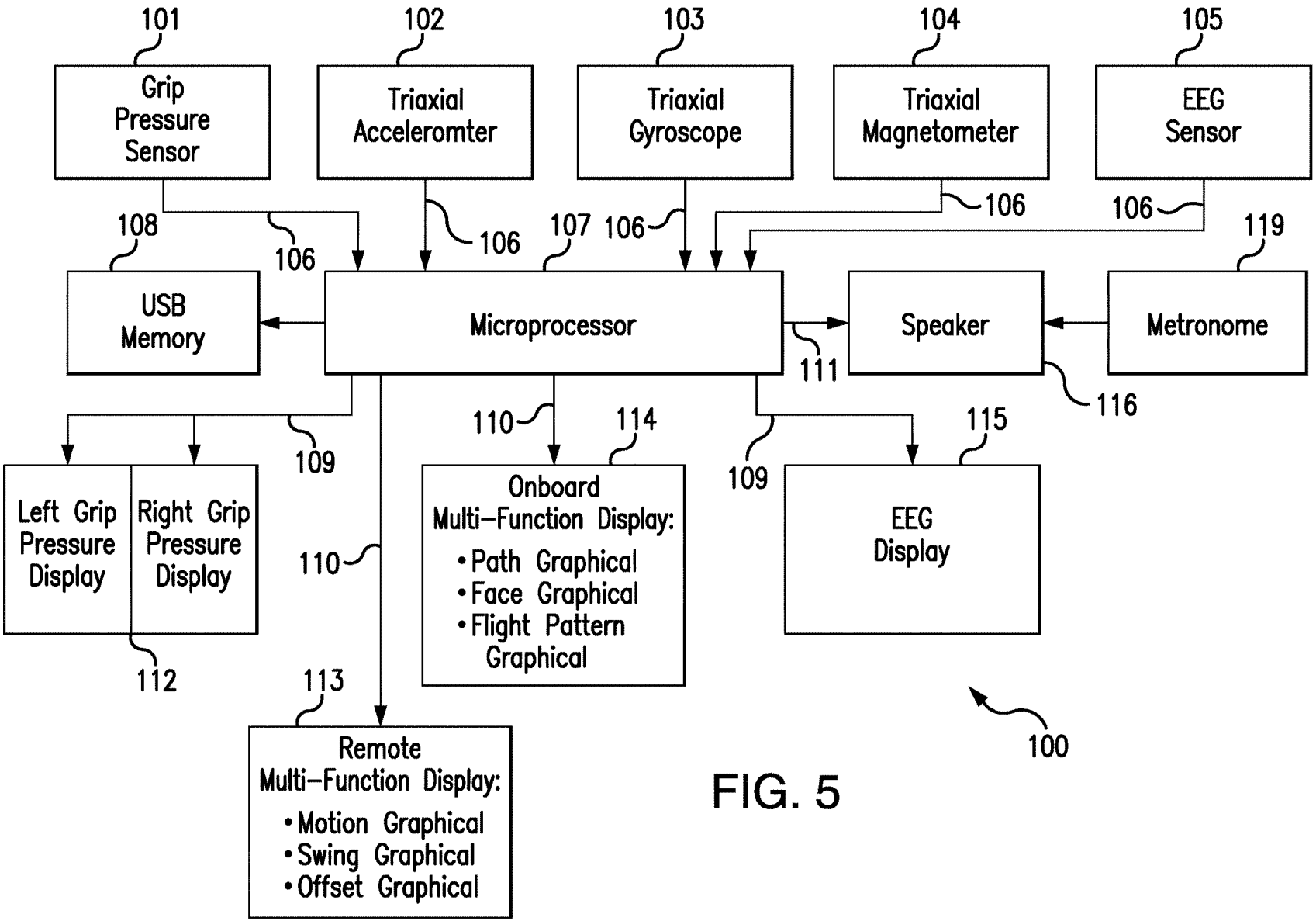
FIG. 5 is a block diagram of the preferred embodiment of the present invention.
Figure 6:
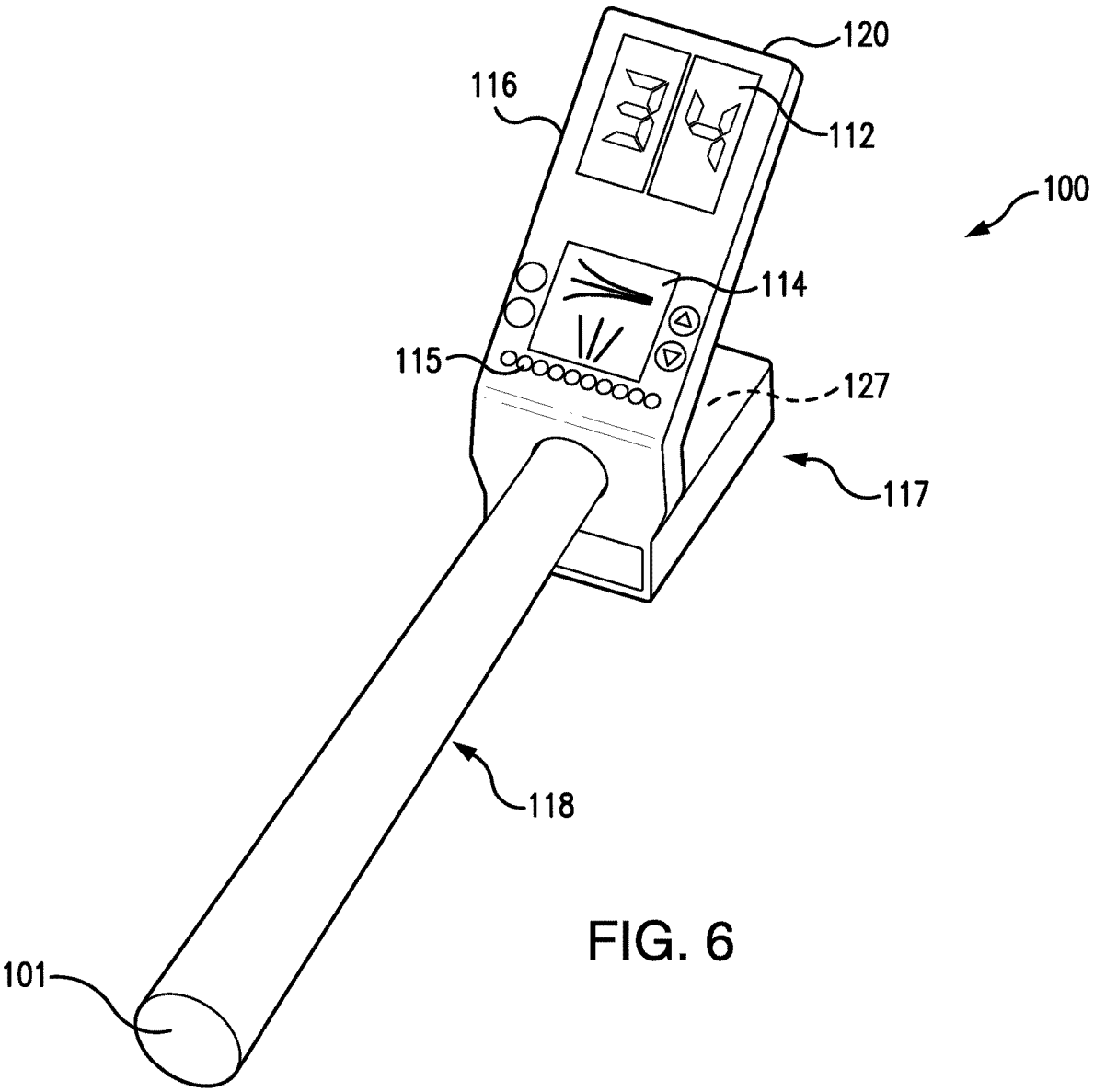
FIG. 6 is a perspective view of the preferred embodiment of the present invention.

FIG. 5 depicts the operative components of the preferred embodiment of the present invention 100 and FIG. 6 shows the physical configuration of the preferred embodiment device 100. The device comprises an array of multiple swing sensors, comprising in this exemplary embodiment dual grip pressure sensors 101, a triaxial accelerometer 102, a triaxial gyroscope 103, a triaxial magnetometer 104, and an EEG sensor 105. These swing sensors 101-105 continuously measure various swing metrics, which are transmitted via digital metric signals 106 to the device's microprocessor 107.

The microprocessor 107 analyzes the metric signals 106 from the swing sensors 101-105 to generate digital swing data, which is descriptive of a swing of the sports striking object 10 by an athlete. The swing data is stored in a device memory 108, which in this embodiment 100 is a USB flash drive. From the swing data, the microprocessor 107 generates digital indicia content 109 and digital graphical content 110, which are transmitted to and visually displayed on one of the device's displays 112-115. From the swing data, the microprocessor also generates audible content that is audibly sounded on a device speaker 116.

In the preferred embodiment 100, the indicia content 109 comprises a pair of pressure numerals 0-9, indicative of the left- and right-hand pressure measured by the dual grip pressure sensors 101 for the left and right hands. The two grip pressure numerals are displayed on the dual grip pressure display 112, which is divided into left- and right-hand sides, as best seen in FIG. 6. In the preferred embodiment 100, the indicia content 109 also comprises a color of one of a row of colored LEDs in the EEG display 115, which are indicative of the mental attention level measured by the EEG sensor.

In the preferred embodiment 100, the graphical content 110 is displayed on two multi-function LED displays 113-114. The remote multi-function display 113 is located on a remote device, such as a smart phone, with which the microprocessor communicates wirelessly, and which alternately displays a motion graphical rendering, a swing graphical rendering, and an offset graphical rendering. The motion graphical rendering is based on measurements of the three-dimensional swing acceleration of the sports striking object 10 by the triaxial accelerometer 102, and it displays swing velocity and/or swing acceleration over time, as well as the spatial position of the sports striking object 10 over time, during each specific swing of the sports striking object 10. The swing graphical rendering is based on the measurements of the three-dimensional swing angular velocity of the sports striking object 10 by the triaxial gyroscope 103, and it displays the angular swing orientation of the sports striking object 10 and the swing path 19 over time during each specific swing of the sports striking object 10. The offset graphical rendering is based on measurements of the three-dimensional angular orientation of the sports striking object 10 with reference to the targeted striking plane 13, and it displays the target offset orientation 17 over time during each specific swing of the sports striking object 10.

Figure 3:
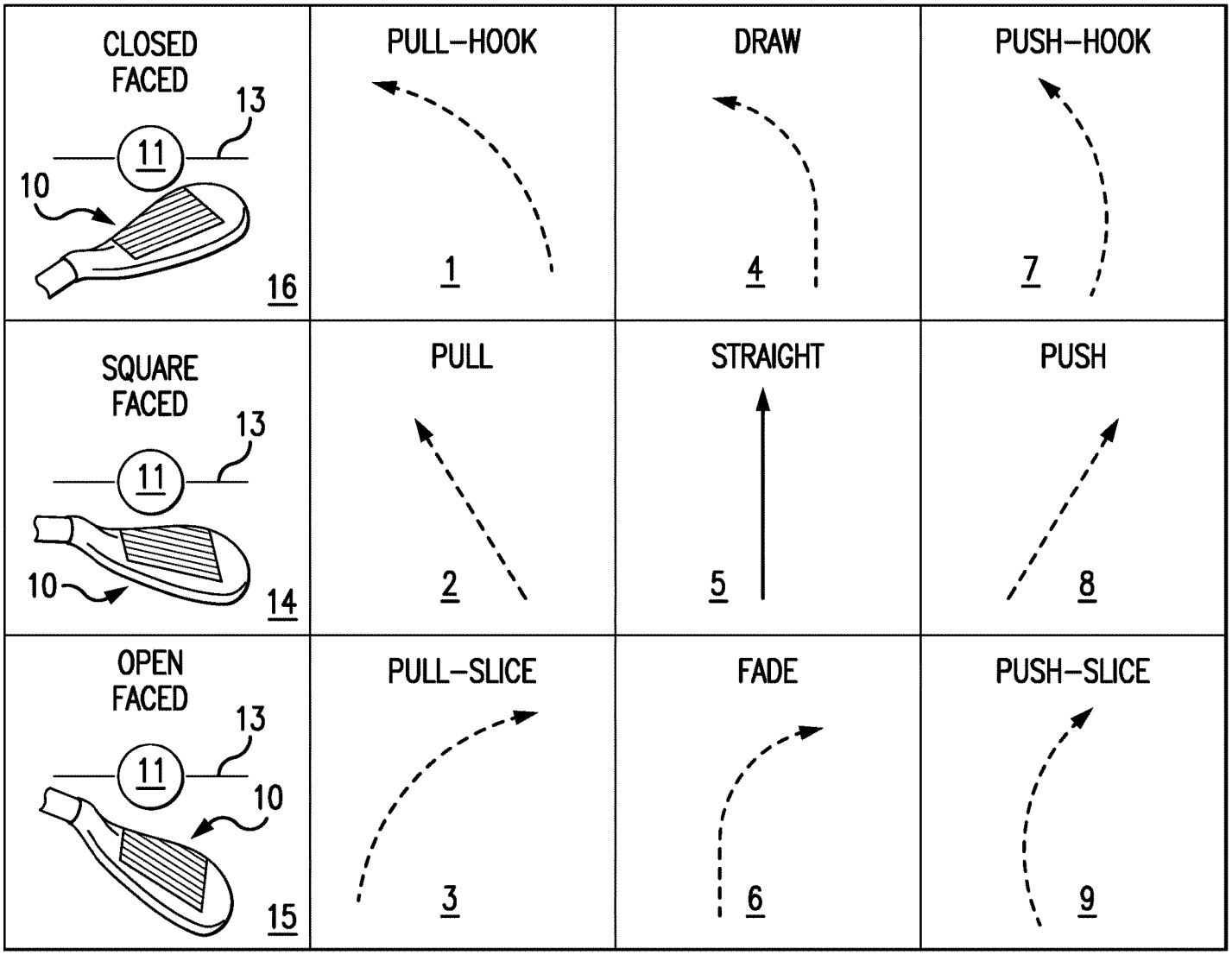
FIG. 3 is a schematic diagram depicting nine flight patterns corresponding to combinations of the three contact orientations with the three swing path orientations.
Figure 4:
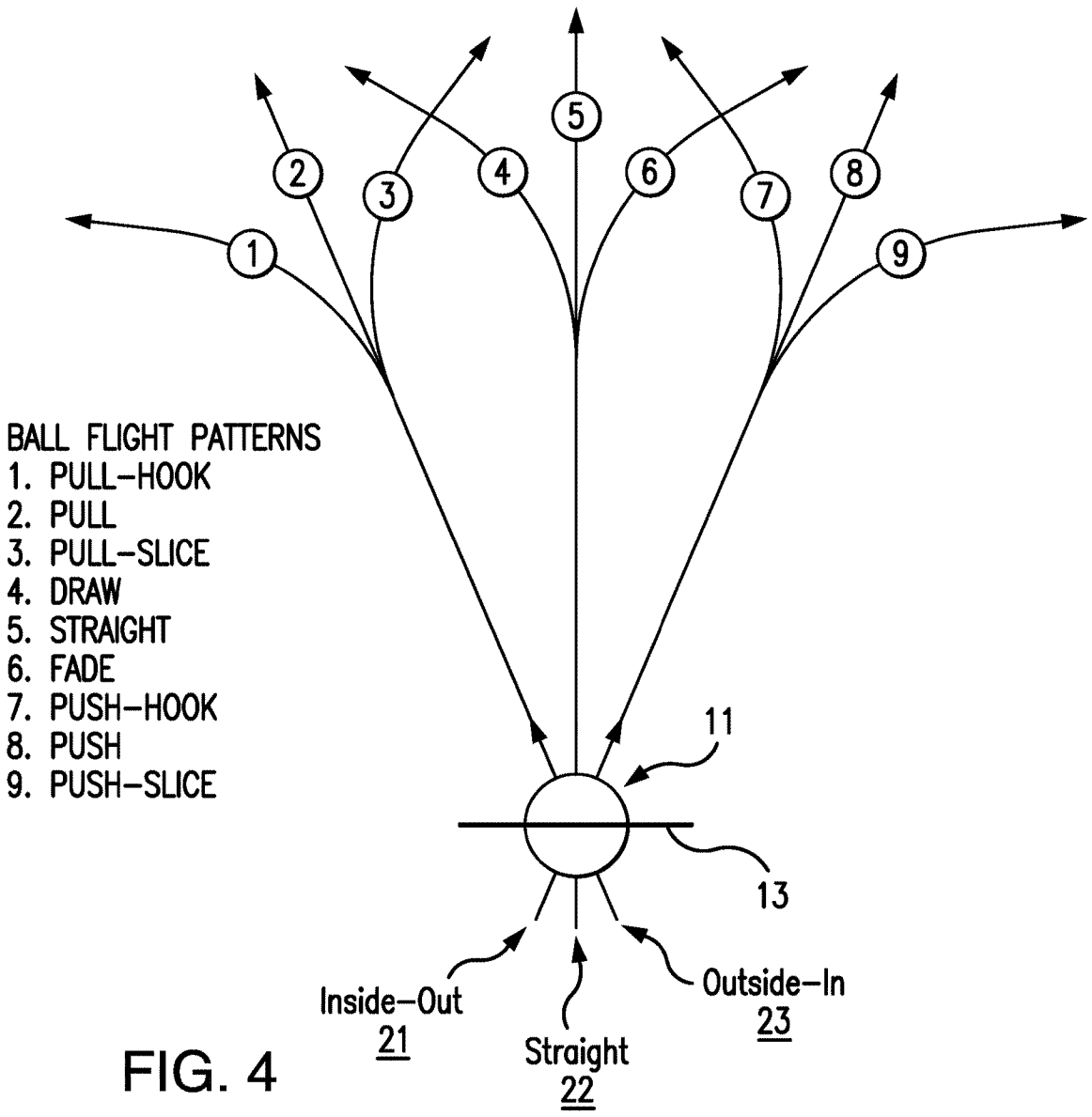
FIG. 4 is a schematic diagram depicting the nine flight patterns.

The onboard multi-function display 114 is located on the device itself, and it alternately displays a path graphical rendering, a face graphical rendering, and a flight pattern graphical rendering. The path graphical rendering displays the swing path orientation 20 at the contact point 18 for each specific swing of the sports striking object 10, as either a posh path 21, a straight path 22 or a pull path 23. The face graphical rendering displays the target offset orientation 17 at the contact point 18 for each specific swing of the sports striking object 10, as either an open-faced orientation 15, a square-faced orientation 14 or a closed-face orientation 16. The flight pattern graphical rendering is based on the combination of the contact swing path orientation 20 and the target offset orientation 17, as best seen in FIGS. 3-4, and it displays a projected flight pattern for each specific swing of the sports striking object as either push-hook 1, pull 2, pull-slice 3, draw 4, straight 5, fade 6, push hook 7, push 8, or push-slice 9.

In the preferred embodiment 100, the audible content 111 comprises a speed signal that sounds through the speaker 116 when the maximum swing velocity, based on data from the accelerometer 102, coincides with the contact point 18. The audible content 117 also comprises adjustable periodic output to the speaker 116 from a metronome 119, which facilitates timing and tempo of the swing.

Referring to FIG. 6, in the preferred embodiment 100, the device comprises a central unit 117 and a grip handle 118. The central unit 117 contains the dual grip pressure display 112, the onboard multi-function display 114, the EEG display 115, the speaker 116, the metronome 119, and a USB port 120 for the flash memory 108. The accelerometer 102, gyroscope 103 and magnetometer 104 are also located in the central unit 117, while the EEG sensor 105 is attached to the athlete's head by a headband, cap or other similar means. The EEG sensor can be of the type described in U.S. Pat. No. 9,532,748, the disclosure of which is incorporated herein by reference.

Figure 7:
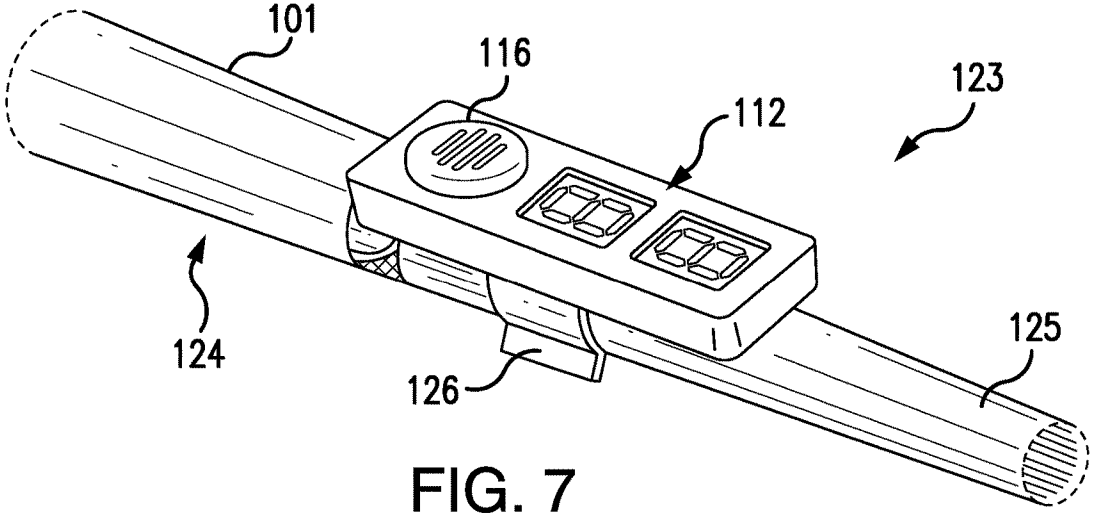
FIG. 7 is a perspective view of an alternate embodiment of the present invention.
Figure 8:
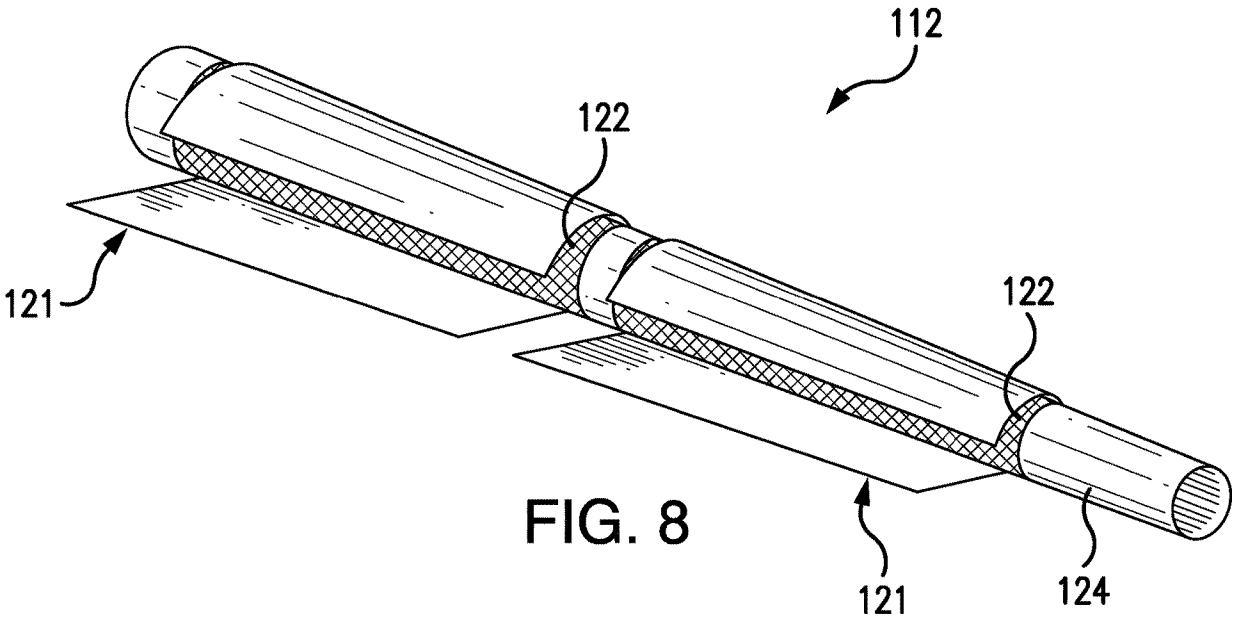
FIG. 8 is a perspective view of a dual grip pressure sensor comprising a two-section, multi-layered, flexible force-sensitive resistor wrap.

The preferred embodiment incorporates the dual grip pressure sensors 101 in the grip handle 118 of the device. The preferred grip pressure sensors 101 comprise a two-section (right and left hand), multi-layered, flexible force-sensitive resistor wrap, as depicted in FIG. 8, with alternating metallic foil 121 and insulation 122 layers. In an alternate embodiment of the device 123, depicted in FIG. 7, the dual grip pressure sensors 101 are applied as a flexible wrap to the swing handle 124 of the sports striking object 10 and the device 123 is attached to the shaft of the sports striking object 125 by a conventional attachment means, such as the clip 126 shown in FIG. 7 or a strap. In the preferred embodiment 100, the grip handle 118 replaces the swing handle 124 of the sports striking object, the shaft 125 of which is insertable into a conjugate shaft aperture 127 in the central unit 117 opposite the grip handle 118. Alternatively, the device 100 can be used alone for training purposes without being attached to another object, in which case it functions as the sports striking object.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. An attachable device for training an athlete to swing a sports striking object at a propelled object, the attachable device comprising:

multiple swing sensors, which are integrated with the attachable device or on the sports striking object or on a sensor item worn by the athlete, wherein each of the swing sensors measure one or more swing metrics and transmit for each swing metric an analog or digital metric signal correlated to the swing metric measured;

at least one microprocessor integrated with the attachable device, wherein the microprocessor communicates with each of the swing sensors and receives from each of the swing sensors the metric signals transmitted, and wherein the microprocessor analyzes and processes the metric signals to generate digital swing data which is descriptive of a swing of the sports striking object by the athlete, and wherein the microprocessor derives from the swing data indicia content and graphical content, which visually represent some or all of the swing data, and audible content, which audible represent some or all of the swing data;

at least one attachable device memory integrated with the attachable device, which communicates with the microprocessor, and which receives and digitally stores the swing data generated by the microprocessor, wherein some or all of the attachable device memory comprises flash memory;

one or more attachable device displays integrated with the attachable device, each of which communicates with the microprocessor, wherein each attachable device display receives and displays the indicia content, the graphical content or both the indicia content and the graphical content of the swing data, wherein one or more of the attachable device displays comprises multi-function displays that distills the swing data to inherently and directly display the necessary swing adjustments to be made to achieve optimal results, and;

one or more attachable device speakers integrated with the attachable device, each of which communicates with the microprocessor, wherein each attachable device speaker receives the audio content of the swing data and produces an audible output based on the audio content received; and one or more means for attaching the attachable device to the sports striking object, or to the athlete, or to both the sports striking object and the athlete.

2. The attachable device according to claim 1, wherein the swing sensors comprise one or more grip pressure sensors, which are located on a grip handle of the attachable device or on a swing handle of the sports striking object, wherein the grip pressure sensors measure one or more manual forces of one or more swing grips of the athlete on the grip handle or on the swing handle, and wherein the grip pressure sensors transmit to the microprocessor analog or digital grip signals, from which the microprocessor generates digital grip pressure data indicative of the manual forces measured by the grip pressure sensors, and wherein the indicia content, or the graphical content, or both the indicia content and the graphical content which are derived from the grip pressure data are displayed on at least one of the attachable device displays.

3. The attachable device according to claim 2, wherein the grip pressure sensors contain pressure sensing elements selected from the group consisting of piezo-resistive force sensors, piezo-electric force sensors, force sensitive resistors, and capacitive force sensors, and wherein the grip pressure sensors comprise flexible wraps applied to the grip handle or the swing handle.

4. The attachable device according to claim 3, wherein the swing sensors comprise two grip pressure sensors, each of which measures the manual forces of one of two hands of the athlete on the attachable device handle or on the swing handle.

5. The attachable device according to claim 4, wherein the attachable device displays comprise two grip pressure displays, and wherein each of the grip pressure display displays the indicia content derived from the grip pressure data corresponding to one of the two hands of the athlete.

6. The attachable device according to claim 1, wherein the swing sensors further comprise at least one triaxial accelerometer or at least three orthogonal single-axis accelerometers, and wherein the accelerometers measure three-dimensional components of a swing acceleration of the sports striking object and transmit to the microprocessor the metric signals correlated to the swing acceleration, and wherein the microprocessor derives from the three-dimensional components of the swing acceleration, as part of the swing data, three-dimensional components of a swing velocity and of a spatial position of the sports striking object over time, as well as a maximum swing velocity and a maximum swing acceleration during a specific swing of the sports striking object, and wherein the microprocessor derives from the swing data the indicia content and the graphical content that visually represent the swing acceleration, the swing velocity, the spatial position of the sports striking object over time, and a swing path of the sports striking object during each specific swing of the sports striking object, and wherein the microprocessor derives from the swing data the audible content that generates an audible speed signal when the maximum swing velocity during each specific swing of the sports striking object coincides with a contact point between the sports striking object and the propelled object.

7. The attachable device according to claim 6, wherein at least one of the attachable device displays depicts at least one motion graphical rendering of the graphical content representing swing velocity over time or the swing acceleration over time, or both the swing velocity over time and the swing acceleration over time, and the spatial position of the sports striking object over time during each specific swing of the sports striking object.

8. The attachable device according to claim 6, wherein at least one of the speakers produces the audible speed signal when the maximum swing velocity coincides with the contact point between the sports striking object and the propelled object.

9. The attachable device according to claim 8, wherein the swing sensors further comprise at least one triaxial gyroscope or at least three orthogonal single-axis gyroscopes, and wherein the gyroscopes measure three-dimensional components of a swing angular velocity and transmit to the microprocessor the metric signals correlated to the three-dimensional components of the swing angular velocity, and wherein the microprocessor derives from the three-dimensional components of the swing angular velocity, as part of the swing data, an angular swing orientation of the sports striking object during each specific swing of the sports striking object, and wherein the microprocessor derives from the swing data the graphical content that visually represent the angular swing orientation and the swing path of the sports striking object during each specific swing of the sports striking object.

10. The attachable device according to claim 9, wherein at least one of the attachable device displays depicts a swing graphical rendering of the angular swing orientation and the swing path over time during each specific swing of the sports striking object.

11. The attachable device according to claim 10, wherein the swing sensors further comprise at least one triaxial magnetometer or at least three orthogonal single-axis magnetometers, and wherein the magnetometers measure angular directional orientation of the sports striking object with reference to a targeted striking plane, in the form of target offset data, and transmit to the microprocessor the metric signals correlated to the target offset data, and wherein the microprocessor derives from the target offset data a target offset orientation of the sports striking object with reference to the targeted striking plane during each specific swing of the sports striking object, and wherein the microprocessor derives from the swing data the graphical content that visually represents the target offset orientation of the sports striking object during each specific swing of the sports striking object.

12. The attachable device according to claim 11, wherein the microprocessor derives from swing data the graphical content that visually describes multiple projected flight patterns associated with multiple corresponding combinations of the swing orientation and the target offset orientation at the contact point of each specific swing of the sports striking object.

13. The attachable device according to claim 12, wherein at least one of the attachable device displays depicts an offset graphical rendering of the graphical contact representing the target offset orientation over time during each specific swing of the sports striking object.

14. The attachable device according to claim 13, wherein at least one of the attachable device displays depicts a path graphical rendering of the graphical content representing the swing path orientation at the contact point of each specific swing of the sports striking object, and wherein the path graphical rendering is depicted as either a push path, a straight path, or a pull path.

15. The attachable device according to claim 14, wherein at least one of the attachable device displays depicts a face graphical rendering of the graphical content representing the target offset orientation at the contact point for each specific swing of the sports striking object, and wherein the face graphical rendering is depicted as either an open-faced orientation, a square-faced orientation, or a closed-faced orientation.

16. The attachable device according to claim 15, wherein at least one of the attachable device displays depicts a flight path graphical rendering of the graphical content representing the projected flight pattern associated with the combination of the swing path orientation and the target offset at the contact point of each specific swing of the sports striking object, and wherein the projected flight pattern is depicted as either pull-hook, pull, pull-slice, draw, straight, fade, push-hook, push, or push-slice.

17. The attachable device according to any one of claims 14-16, wherein the attachable device further comprises a metronome configured to generate an audible periodic output through one of the attachable device speakers, wherein the periodic output has an adjustable period interval which is adjusted to synchronize with a swinging motion of the sports striking object.

18. The attachable device according to any one of claims 14-16, wherein the swing sensors further comprise at least one EEG sensor, which monitors an attention level of the athlete during each specific swing of the sports striking object, wherein the EEG sensor transmits an analog or digital EEG signal to the microprocessor, which analyzes and processes the EEG signal to generate attention level data, and wherein at least one of the attachable device displays depicts attention indicia based on the attention level data.

19. The attachable device according to claim 17, wherein the swing sensors further comprise at least one EEG sensor, which monitors an attention level of the athlete during each specific swing of the sports striking object, wherein the EEG sensor transmits an analog or digital EEG signal to the microprocessor, which analyzes and processes the EEG signal to generate attention level data, and wherein at least one of the attachable device displays depicts attention indicia based on the attention level data.

20. The attachable device according to claim 1, wherein one or more of the attachable device displays comprise remote displays that communicate wirelessly with the microprocessor.

* * * * *